US005464316A

United States Patent [19]

Kranz

[11] Patent Number: 5,464,316

[45] Date of Patent: Nov. 7, 1995

[54] ENVELOPE ACCUMULATION, BATCHING AND COMPRESSION APPARATUS AND METHOD

[75] Inventor: Richard Kranz, Leawood, Kans.

[73] Assignee: Tension Envelope Corporation, Kansas City, Mo.

[21] Appl. No.: 104,663

[22] Filed: Aug. 11, 1993

Related U.S. Application Data

[63] Continuation-in-part of Ser. No. 55,513, Apr. 29, 1993, Pat. No. 5,421,700.

[51] Int. Cl.[6] ..... B65G 57/00

[52] U.S. Cl. ..... 414/798.2; 414/798.9; 271/2; 198/418.7; 198/429

[58] Field of Search ..... 414/798.2, 798.4, 414/798.5, 798.9, 792.5; 198/418.7, 418.8, 429; 271/2

[56] References Cited

U.S. PATENT DOCUMENTS

| | | | |
|---|---|---|---|
| 3,593,486 | 12/1969 | Helm . | |
| 3,826,348 | 7/1974 | Preisig et al. | 414/798.9 |
| 3,847,384 | 11/1974 | Bethke . | |
| 4,506,882 | 3/1985 | Ito et al. . | |
| 4,611,705 | 9/1986 | Fluck | 414/798.9 |
| 4,674,934 | 6/1987 | Hanger | 414/798.2 |
| 4,711,441 | 12/1987 | Taylor . | |
| 4,718,655 | 1/1988 | Okayama et al. . | |
| 4,736,936 | 4/1988 | Hertel et al. . | |
| 4,828,101 | 5/1989 | Fluck | 198/418.7 |
| 4,835,947 | 1/1989 | Langen et al. . | |
| 4,869,359 | 9/1989 | Muller et al. | 414/798.9 |
| 4,921,088 | 5/1990 | Ter Horst | 198/418.7 |
| 4,930,977 | 6/1990 | Beeman et al. . | |
| 4,940,223 | 7/1990 | Weigel et al. . | |
| 5,011,132 | 4/1991 | Guttinger et al. . | |
| 5,046,711 | 9/1991 | Merwarth et al. . | |

*Primary Examiner*—Michael S. Huppert
*Assistant Examiner*—Gregory A. Morse
*Attorney, Agent, or Firm*—Litman, McMahon and Brown

[57] ABSTRACT

An envelope accumulation and batching apparatus and method uses a conventional envelope delivery spider which has been adapted to deliver envelopes to an accumulating surface, such as a belt conveyor, in a position with the folded envelope seal flaps facing upward. A rotary guide is positioned with radially extending guide members extending just above the conveyor belt to guide envelopes onto the conveyor in an upright orientation. The conveyor moves the envelopes toward a series of three separately movable, vertically oriented finger supports. The three supports are cooperatively driven to accumulate, batch and compress horizontal stacks of predetermined numbers of envelopes which are then positioned beneath a gripper assembly with a pair of opposed gripper arms. The gripper assembly is lowered into a position in which the gripper arms are inserted on either side of the compressed envelope stack, pulled together and pivoted inward at the bottoms to squeeze the stack from the bottom edges. The gripper assembly is then lifted to pick up the stack from the conveyor.

32 Claims, 4 Drawing Sheets

ENVELOPE ACCUMULATION, BATCHING AND COMPRESSION APPARATUS AND METHOD

CROSS REFERENCE TO RELATED APPLICATIONS

This application is a continuation-in-part of U.S. patent application Ser. No. 08/055,513, filed Apr. 29, 1993, and entitled Envelope Flap Up Pick and Place Apparatus and Method, now U.S. Pat. No. 5,421,700.

BACKGROUND OF THE INVENTION

1. Field of the Invention

The present invention relates to an automatic envelope processing apparatus and method, and, more particularly, to such an apparatus which removes completed envelopes from an envelope folding machine, maneuvers them such that their folded-down top seal flap is placed upward, and deposits them in a horizontal stack on a receiving surface. A pair of cooperating movable supports then compresses individual stacks, each containing a predetermined number of envelopes, and positions them for a mechanical gripper to grasp the compressed stacks, lift them without bottom support and move them to another location for a further operation, such as packaging.

2. Description of the Related Art

Envelope manufacturing in general has increasingly become a highly automated operation. In the production of standard and specialty envelopes, large, complex machines serve to fold blanks, apply patches, and place adhesive on the side and top or seal flaps. The side flaps are folded over and sealed and the finished envelopes are normally output via a delivery spider into a horizontal stack on a surface, such as a conveyor belt, to be accumulated into stacks of envelopes for other operations, such as loading into cartons.

These accumulating and loading steps have been difficult to fully automate, thus usually requiring hand operations. In the past, conventional delivery spiders have fed the finished envelopes onto the delivery surface with the folded seal flap facing downward. As these envelopes with downward facing folded seal flaps accumulate on the receiving surface, the cumulative outward acting horizontal spring effect caused by the extra paper layers in the downward facing folded seal flaps tends to spread or expand the envelope stack longitudinally outward at the bottom. No gripping or picking machine is known which is capable of reliably automatically picking up the requisite number of envelopes from the horizontal stack and moving them away from the stacking area without dropping them. This is due to the "spring" action of the extra paper layers represented by the folded, open seal flaps which tends to bow the envelope stack outward at the bottom edges, causing envelopes in the middle of the stack to bulge downwardly and drop out, usually followed by the remainder of the stack.

As a result of this inability to design a suitable machine, and as further described below, it has been traditional for human workers to physically grasp the horizontal stacks of envelopes, carefully compensating for the greater bulk at the bottom, and lift them for transfer to a desired location, such as an open carton. There are a number of problems inherent in this arrangement. First, the use of manual labor is expensive, when compared to automated equipment. Second, the workers themselves face the same problem with the envelope stacks, i.e., once they are picked up by compressing the stacks inwardly from the ends, the spring action of the downward facing folded seal flaps tends to cause envelopes to loosen at the bottom and drop out. This means that the workers must manually exert a considerable compensating force inward against the bottom edges of the envelope stack, effectively squeezing the stack bottom to prevent the stacks from falling apart as they are lifted. Often the workers find it easier to turn the stack 180 degrees so the seal flaps are facing up, but the turning operation itself is difficult and likely to cause the stack to disintegrate. The handling of the stacks leads to the third problem, which is that these repetitious manual lifting, squeezing and turning motions, when repeated hour after hour and day after day, frequently cause the affected workers to develop carpal tunnel syndrome. This is an extremely painful nerve, muscle and ligament irritation in the wrists and hands which can cause temporary and even permanent disability in the workers. In addition to the problem of the resulting pain and suffering, these injuries represent a considerable financial strain in the form of workmen's compensation, lost wages, sick leave, etc. to an envelope manufacturer.

It is clear then, that a need exists for an automated apparatus which is capable of effectively and reliably off-loading stacks of envelopes from a receiving surface, accumulating, counting, and picking up predetermined numbers of the envelopes in horizontal stacks from the surface, and transferring them to other locations during the manufacturing/packaging process. Such an apparatus should be capable of reliably picking up and loading the stacks of envelopes, i.e. the apparatus must solve the problem of the bottom spring action caused by the loading of envelopes with downward facing folded envelope seal flaps.

SUMMARY OF THE INVENTION

The present invention is directed to an envelope accumulation and batching apparatus and method for a system including a delivery spider which transfers finished envelopes from an envelope folding machine to a receiving surface, in this example a horizontal belt conveyor. The delivery spider accepts finished envelopes from a series of rollers with the final roller pushing the envelopes downward, flap first, into upward facing slots in the delivery spider. The delivery spider turns clockwise, as shown in the drawings, moving the envelopes until the top of each envelope contacts a pair of horizontally oriented hold back fingers, which cause the envelope to drop out of the delivery spider, and onto the conveyor belt. The envelopes, as they drop onto the conveyor belt, are dropped between respective guide members on a guide wheel which is mounted in a position in which the guide members extend just above the belt. The guide wheel turns in a direction opposite of the spider, with the guide members feeding the envelope bottoms smoothly onto the belt in an upright orientation where they accumulate into a horizontal stack. The stacked envelopes are thus loaded onto the conveyor belt in a position with their folded seal flaps facing upward and away from the delivery spider.

As the envelopes are loaded onto the conveyor belt, accumulation and hatching is accomplished via first, second and third movable vertically oriented finger supports. The first movable vertically oriented finger support is positioned to extend above the conveyor belt, holding the stack upright. This first vertical finger support is attached to a double acting piston within a pneumatic cylinder, which moves the first finger support in the same direction as the conveyor belt, and at a speed which matches the accumulation speed of the loaded envelopes. When a predetermined number of envelopes have been loaded, as determined by a counter, the second and third vertically oriented finger supports are simultaneously propelled upward into the stack of envelopes. The result is a stack including the predetermined number of envelopes, which stack is positioned between the first finger support and the second finger support.

The second and third finger supports are attached to pistons within a respective pair of vertically oriented pneumatic cylinders which are operative to raise and lower the respective second and third supports. Pistons in a respective pair of horizontally oriented pneumatic cylinders are attached to respective ones of the vertically oriented pneumatic cylinders such that the vertically oriented cylinders, along with the attached second and third finger supports, are independently movable in the same plane as the conveyor belt.

After the second and third finger supports are pushed upward into the envelope stack, they are moved in the same direction as the conveyor belt, but the second finger support is moved faster than the third finger support, thus compressing the envelope stack between the first and second finger supports. The first finger support reaches the end of its travel path as the envelope stack is fully accumulated, batched, and compressed.

A gripping and transfer apparatus then pushes two downwardly extending gripper arms into the first and second finger supports, respectively. The gripper arms include fingers which mesh with the fingers in the first and second finger supports. The gripping and transfer apparatus then squeezes the two downwardly extending gripper arms together at the bottom and picks up the gripped envelope stack off of the conveyor belt, urging the envelope stack upward against a bowed top support and then transferring it for further operations such as packing or the like. As the stack is picked up off of the conveyor belt, the first finger support is moved in a direction opposite that of the conveyor belt, to the opposite limit of its travel, whereupon the second and third support fingers are pulled downward below the plane of the conveyor belt. Envelopes thus begin collecting against the first finger support, which is again propelled in the direction of the conveyor at the accumulation speed of the envelopes, and the cycle is repeated.

OBJECTS AND ADVANTAGES OF THE INVENTION

The principal objects of the present invention include: to provide an improved envelope accumulation and batching apparatus and method; to provide such an apparatus in which finished envelopes are reliably transferred from an envelope folding apparatus to a horizontal belt conveyor; to provide such an apparatus in which the envelopes are loaded onto the conveyor with their open, folded seal flaps directed upward; to provide such an apparatus in which a plurality of movable upright finger supports cooperate to accumulate, batch and compress individual stacks of envelopes, with each stack including a predetermined number of envelopes; to provide such an apparatus in which a pair of mechanical gripper arms are lowered on either side of each individual stack, after it has been accumulated, batched and compressed; to provide such an apparatus in which the mechanical gripper arms are pulled toward each other, squeezing and gripping the stack of envelopes, with the gripper arms then being lifted to pick up and convey the stack of envelopes away from the conveyor belt; to provide such a method in which envelopes are transferred from a manufacturing apparatus to a belt conveyor; to provide such a method in which the envelopes are stacked, open, folded seal flap upward, on the conveyor belt; to provide such a method in which horizontal stacks of predetermined numbers of envelopes are accumulated and compressed on the conveyor belt; to provide such a method in which the stacks of accumulated and compressed envelopes are mechanically picked up off of the conveyor belt and transferred to waiting cartons; to provide such a method in which an existing envelope folding machine which normally loads envelopes open, folded seal flap down onto a belt conveyor is converted to transfer envelopes, open flap up onto the belt conveyor; and to provide such an apparatus and method which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Prior Art

Figure 3:
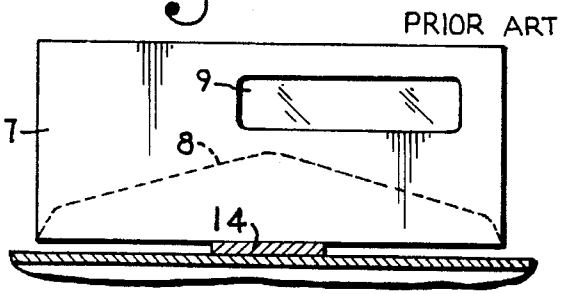
FIG. 3 is an enlarged, cross-sectional view of an envelope positioned in the horizontal stack of FIG. 2, taken along line 3—3 of FIG. 2, and showing the folded seal flap in phantom lines, facing down and toward the delivery spider.
Figure 2:
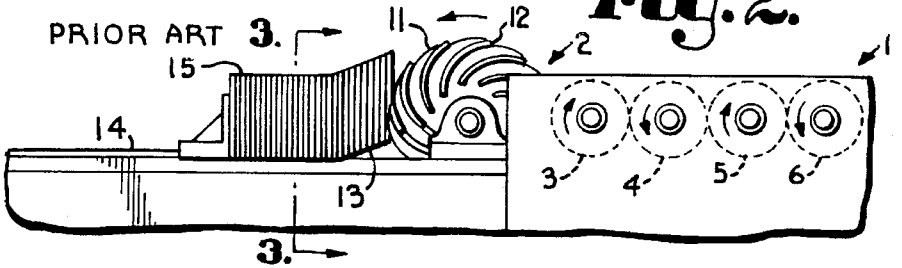
FIG. 2 is an illustration of a conventional, prior art, envelope folded seal flap down transfer mechanism.
Figure 4:
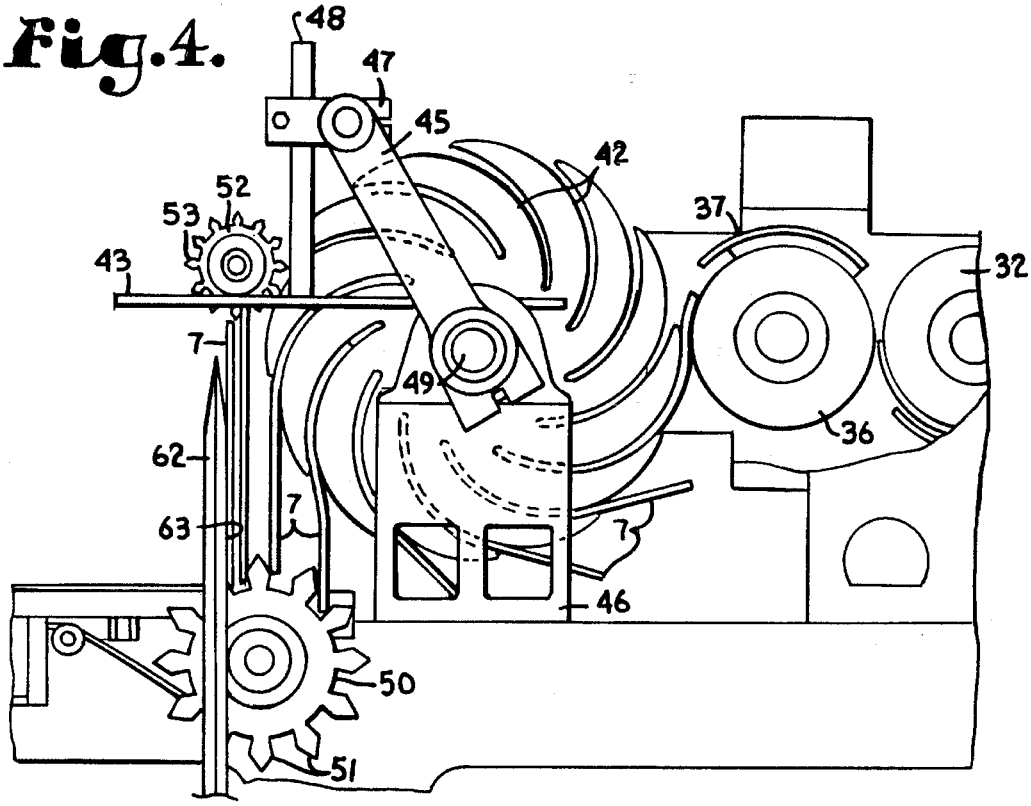
FIG. 4 is an enlarged, fragmentary side elevational view of an envelope flap up delivery system, showing a second and third finger support extending upward into the horizontal envelope stack.

FIGS. 2 and 3 illustrate a typical prior art envelope folding apparatus 1 with a flap down conveyor transfer assembly 2. The transfer assembly 2 includes a plurality of rollers 3–6 which serve to seal the side flaps of the finished envelopes 7, leaving a seal flap 8 open. The envelopes 7 may include a transparent window patch 9. The envelopes 7 are directed into a delivery spider 11. The spider 11 includes a plurality of curved envelope slots 12 which receive envelopes 7 as they exit the last roller 3, which is rotated clockwise, as illustrated in FIG. 2. The envelopes 7 enter the slots 12, folded seal flap first, and the spider 11 is rotated counter-clockwise, or opposite to that of the roller 3. A limit stop 13 causes the envelopes to drop out of the slots 12 and fall onto a receiving surface 14. The envelopes 7 drop onto the surface 14, folded seal flap first, and are accumulated into a horizontal stack 15. A human workman (not shown) then manually grasps individual stacks of predetermined numbers of envelopes 7, lifting them from the surface 14 and transferring them to open cartons for packaging. The outward spring pressure on the bottom of the stack 15, due to the extra paper layers represented by the downward facing folded seal flaps 8, means that a great deal of compensating pressure must be exerted manually by the workman against the bottom ends of the stack 15 to keep the stack 15 from falling apart, i.e. to keep the envelopes 7 from dropping out of the stack 15 when it is lifted from the receiving surface 14. This exertion of manual pressure, when repeated hundreds of times daily, causes the workmen to develop carpal tunnel syndrome, as explained above.

Envelope Flap Up Pick and Place Apparatus and Method

Figure 1:
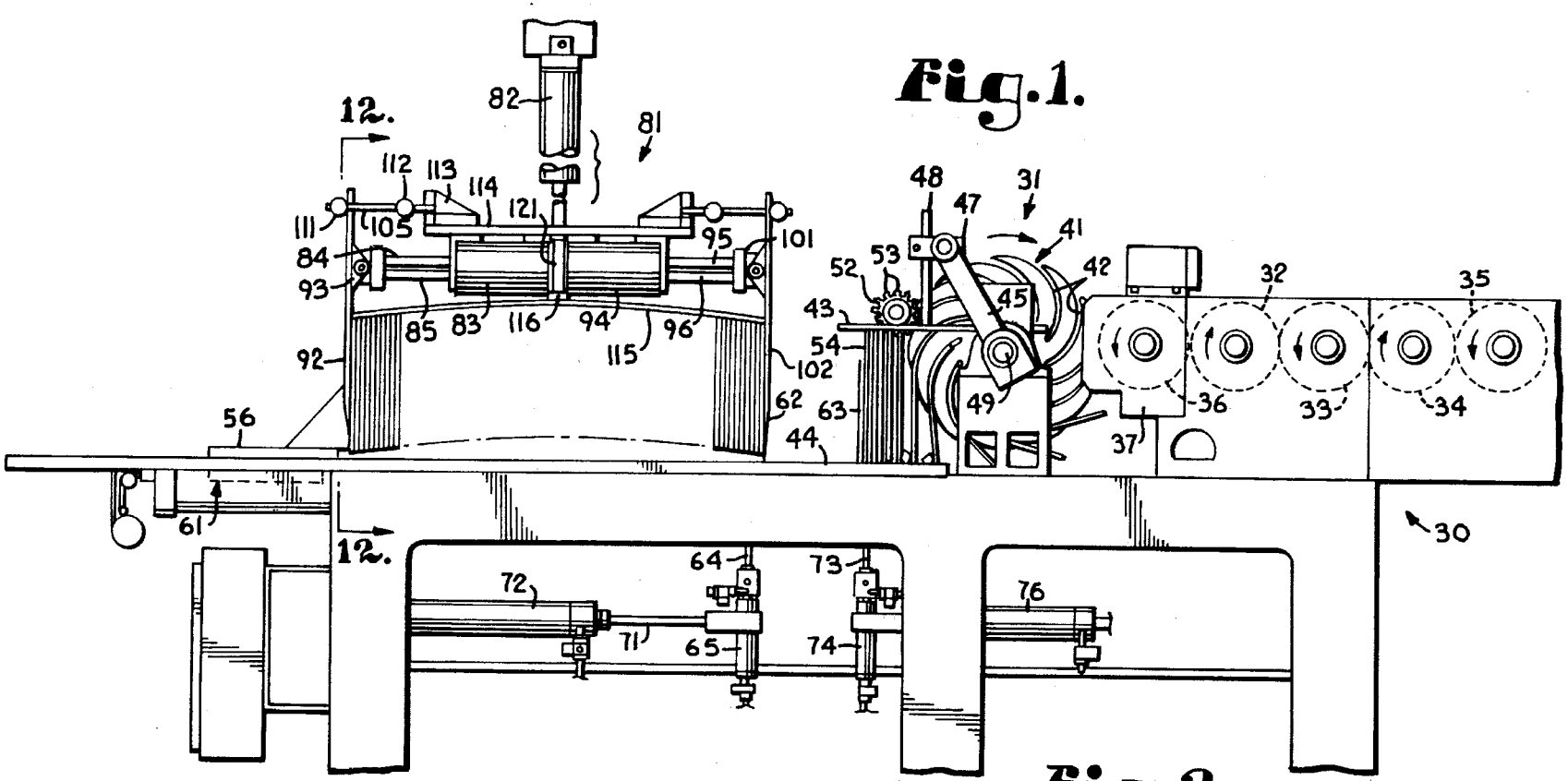
FIG. 1 is a side elevational view of the envelope flap up and pick apparatus and method in accordance with the present invention.

The present invention, as illustrated in FIGS. 1 and 4–12, is designed to automate the processing of envelopes 7 previously accomplished manually in the system 1. Referring to FIG. 1, the number 30 generally indicates an envelope folding machine, which may be, for example, a Type 527 Envelope Machine manufactured by Winkler and Dunnebier of Germany. The numeral 31 generally indicates an envelope sealing and transfer assembly attached to the machine 30 in accordance with the present invention. The assembly 31 includes a number of rollers 32–35, which seal envelope side flaps and direct the envelopes 7 in the same manner as the rollers 3–6 in the system 1. An additional roller 36, with an envelope keeper 37, is added to direct the envelopes 7 in a downward direction into a delivery spider 41, which includes curved envelope slots 42. The spider 41 is mounted with the slots 42 running in a direction opposite to the slots 12 of the prior art spider 11. The envelopes 7 exit the roller 35 and enter the slots 42, open, folded seal flap first. The spider 41 rotates in a clockwise direction, as pictured in FIGS. 5–10, and a limit stop 43 causes the envelopes 7 to drop out of the slots 42 and onto a belt conveyor 44. An angled adjustment arm 45 is connected to a spider axle support 46 at one end and to a slotted horizontal plate 47 at the other end. The plate 47 supports a vertical member 48, which, in turn, supports the limit stop 43. The height of the limit stop 43 can be adjusted to accommodate for envelopes 7 of differing heights by rotating the arm 45 about the support 46 and an axle 49. A rotary guide 50, with radially extending guide members 51 which extend just above the conveyor 44, guides the envelopes 7 in an upright orientation onto the conveyor 44. An additional, smaller rotary guide 52 is positioned above the guide 50, and includes individual guide members 53. The guide 52 can also serve as a counter trigger for an envelope counter (not shown).

Envelope Accumulation and Batching Apparatus and Method

Figure 5:
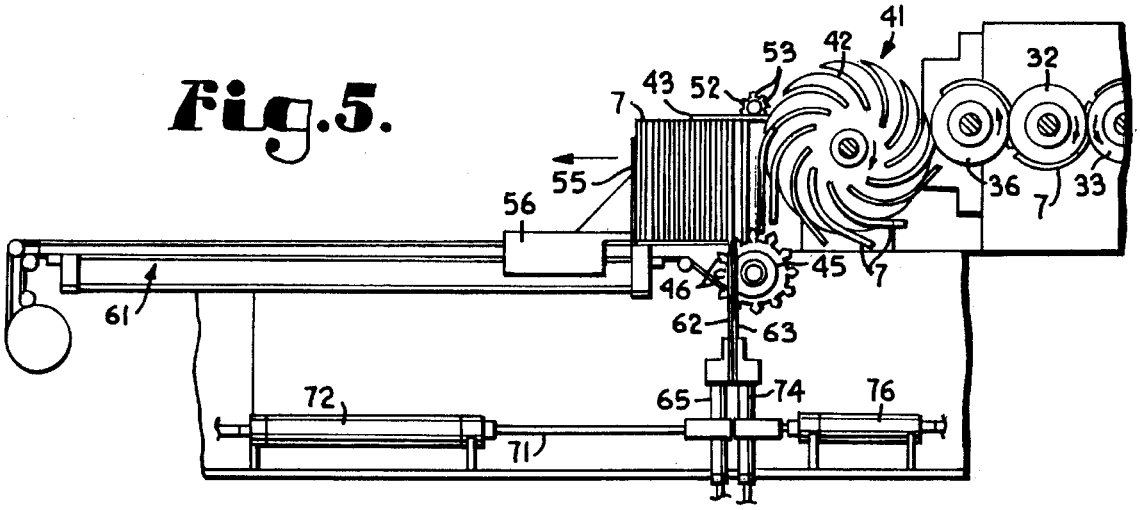
FIG. 5 is a reduced, fragmentary side elevational view of the system including the accumulation, batching and compression apparatus, showing the second and third finger supports pulled down below the conveyor, and with envelopes accumulating behind the first finger support.

As the envelopes 7 are guided onto the conveyor 44, they form a horizontal stack 54. A first movable, vertically oriented finger support 55 serves to hold the envelopes 7 in an upright position. The first support 55 is connected to a carriage 56, which is, in turn, connected to a dual acting piston within a pneumatic cylinder 61. The cylinder 61 has a two-way action, i.e. air under pressure can be introduced at either end to propel the piston and attached carriage 56 to the left or right. Compressed air introduction into the cylinder 61 is timed such that the carriage 56 and first support 55 are propelled to the left, as shown in FIG. 5, at the same rate of speed that the envelopes 7 accumulate on the conveyor 44. Thus, the first support 55 holds the envelope stack 54 in a vertical orientation without putting pressure on the stack 54.

Figure 6:
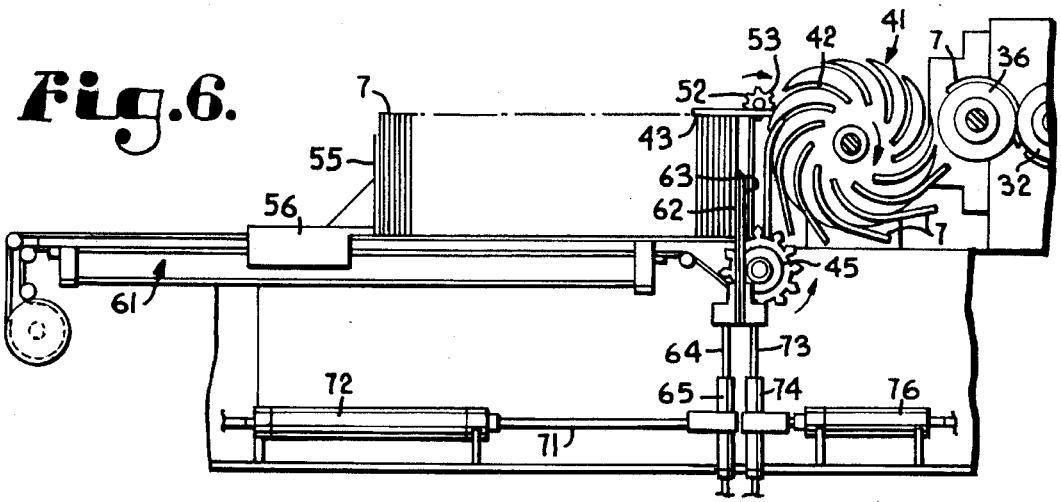
FIG. 6 is a reduced, fragmentary side elevational view of the system including the accumulation, batching and compression apparatus, showing the second and third finger supports hatching a predetermined number of envelopes as they are pushed up into the envelope stack, and with the next batch of envelopes beginning to accumulate behind the third finger support.

When a predetermined number of envelopes 7 have been counted, by a counter connected to the guide 52, or by other counting mechanisms, such as photoelectric detectors, etc., a second and a third movable finger support 62 and 63, are propelled upward, side by side, into the envelope stack 54, as shown in FIG. 6. The second support 62 is connected to a rod 64 connected to a vertically oriented pneumatic cylinder and piston 65. The cylinder 65 is, in turn, connected to a rod 71, which is connected to a piston within a horizontally oriented pneumatic cylinder 72. Similarly, the third support 63 is connected to a rod 73 connected to a vertically oriented pneumatic cylinder and piston 74. The cylinder 74 is, in turn, connected to a rod 75, which is connected to a piston within a horizontally oriented pneumatic cylinder 76. Each of the cylinders 65, 72, 74 and 76 are double acting pneumatic cylinders similar to the cylinder 61, but with shorter piston strokes.

Figure 7:
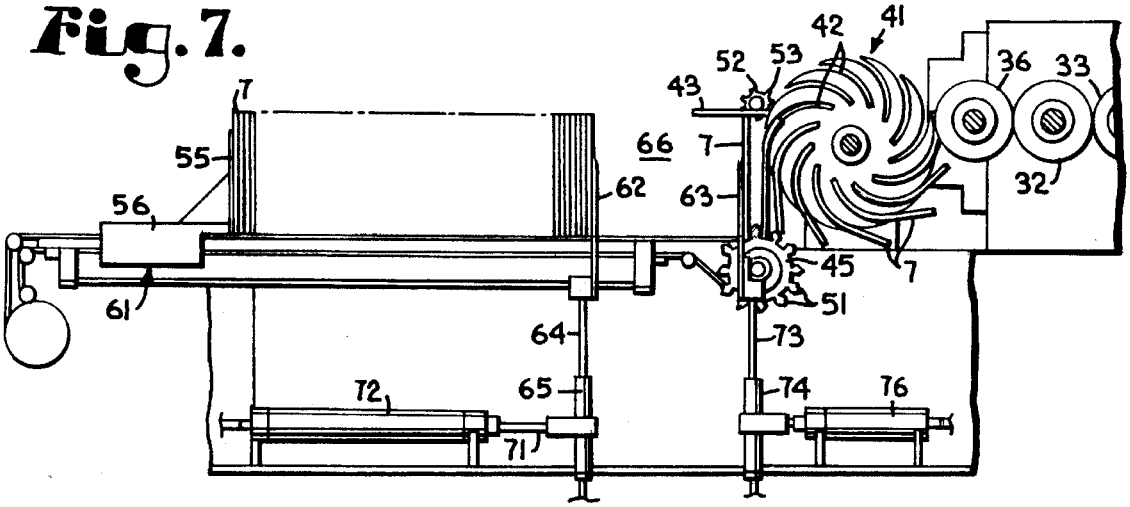
FIG. 7 is a reduced, fragmentary side elevational view of the system including the accumulation, batching and compression apparatus, showing the second and third finger supports being advanced to the left, with the second support moving faster than the third support, and serving to compress the batched stack of envelopes against the first support.

After the second and third supports 62 and 63 have been propelled upward into the envelope stack 54, as shown in FIG. 6, the second support 62 is propelled relatively rapidly to the left by the horizontal cylinder 72, as shown in FIG. 7, while the third support 63 is also propelled to the left by the horizontal cylinder 76, but at a significantly lower speed. This causes the second and third supports 62 and 63 to separate, leaving a gap 66 as shown in FIG. 7, as the second support 62 compresses the envelope stack 54 against the first support 55, which has now reached the leftmost end of the piston stroke within the cylinder 61.

Figure 11:
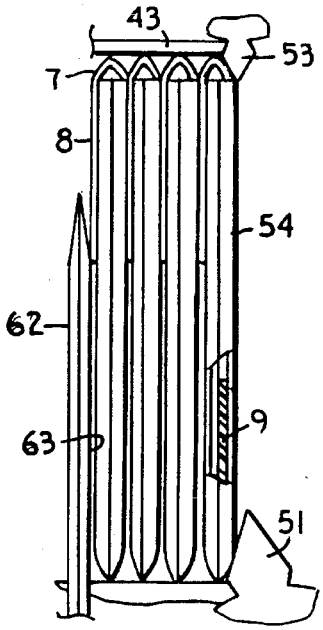
FIG. 11 is a greatly enlarged, fragmentary side elevational view of a stack of envelopes accumulating behind the third finger support, showing the folded seal flap up orientation of the envelopes.

FIG. 11 illustrates a stack of the envelopes 7 as they are accumulated behind the third support 63 and guided by guide members 51 and 54 of the rotary guides 50 and 51, respectively. As the envelopes 7 are guided onto the conveyor 44, the folded seal flaps 8 face away from the spider 41, with the windows 9 facing toward the spider 41. FIG. 11 also illustrates the spring action exerted by the open, folded seal flaps 8, as the seal flaps 8 at the tops of the envelopes 7 tend to spring outward due to the additional paper layers, making the envelopes 7 thicker at the top than the bottom, and tapering the entire stack 54 outward at the top.

Multiple Envelope Gripping and Transfer Apparatus and Method

Figure 12:
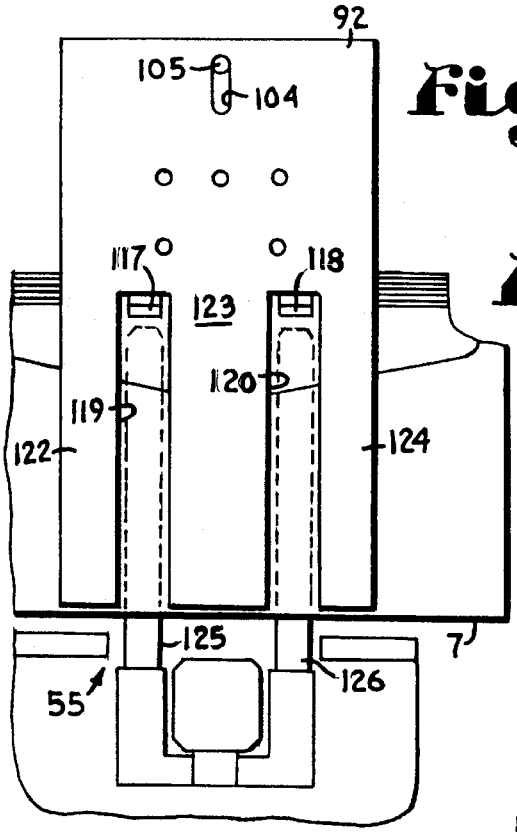
FIG. 12 is an enlarged, cross-sectional view, taken along line 12—12 of FIG. 1, and showing fingers in the left gripper arm meshing with fingers in the first finger support.
Figure 13:
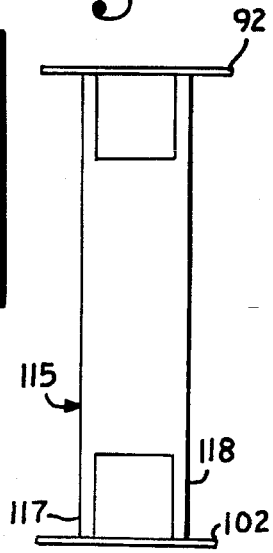
FIG. 13 is an enlarged, cross-sectional view, taken along line 13—13 of FIG. 8, and showing a bowed top support in the gripping and transfer apparatus positioned between the two gripper arms.
Figure 8:
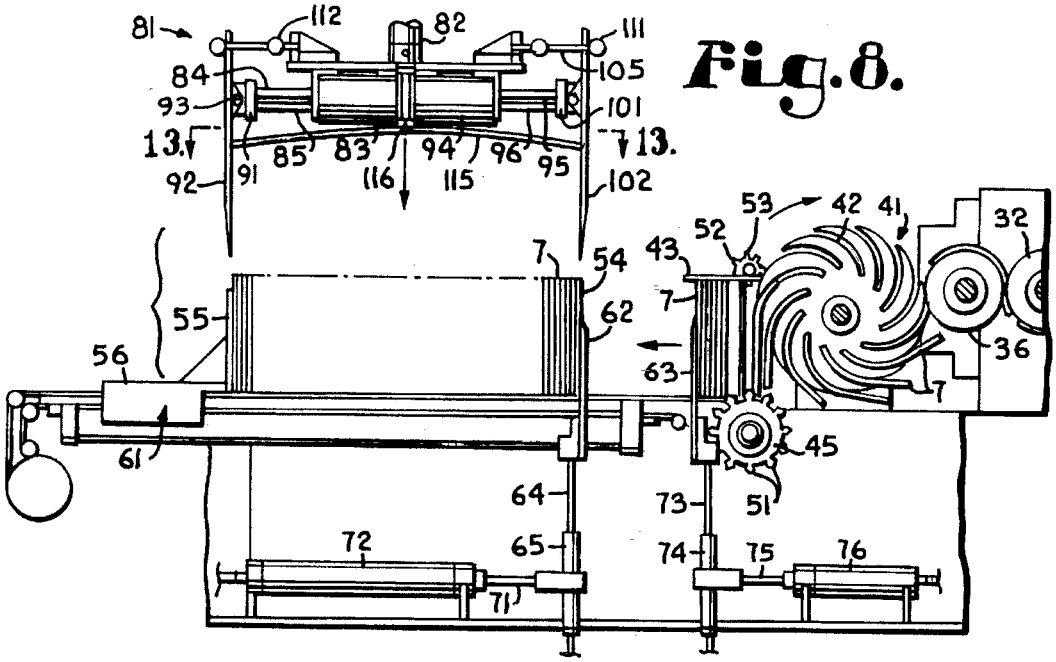
FIG. 8 is a reduced, fragmentary side elevational view of the system including the accumulation, batching and compression apparatus, showing, showing the batched envelope stack compressed and positioned for a gripping and transfer apparatus, with the gripping and transfer apparatus being lowered toward the envelope stack, and with additional envelopes accumulating behind the third support.

Next, as shown in FIG. 8, a gripper assembly 81 is lowered by a vertically oriented pneumatic cylinder 82 (FIG. 1). A first double rod horizontally oriented air cylinder 83, equipped with rods 84 and 85, is connected to a plate 91, which is pivotally connected to a left gripper arm 92 via a pivotable connector 93. The rods 84 and 85 are simultaneously extendable and retractable by the cylinder 83. Similarly, a second double rod horizontally oriented air cylinder 94, equipped with rods 95 and 96, is connected to a plate 101, which is pivotally connected to a right gripper arm 102. The gripper arms 92 and 102 are mirror images of each other and, thus, only the gripper arm 92 will be further described herein, with particular reference to FIGS. 1 and 12. The gripper arm 92 is tapered near the bottom, and includes a slot 104 near the top. The slot 104 is sized and adapted to accommodate and move freely along a threaded adjustment rod 105, which incorporates a pair of threaded stops 111 and 112. The adjustment rod 105 is threaded into a support 113, which is rigidly attached to a horizontal cylinder support arm 114. A bowed stack top support 115 is attached beneath the center of the gripper assembly 81 between the gripper arms 92 and 102. The support 115 curves downward at either end. Referring to FIGS. 12 and 13, the support 115 is shown as a plate cut to yield a pair of spaced feelers 117 and 118 on either end. The fingers 117 and 118 extend through corresponding elongate slots 119 and 120 in the gripper arms 92 and 102. The slots 119 and 120 allow the respective fingers 117 and 118 to extend outward past the gripper arms 92 and 102 as they are pivoted inward at the bottom, as shown in FIG. 12. The support 115 is attached to the cylinder support plate 114 via a countersunk threaded screw 116, which extends into a vertical cylinder support 121.

Referring to FIG. 12, the gripper arm 92 includes a plurality of fingers 122–124 defined by the elongate slots 119 and 120, which fingers 122–124 mesh with corresponding fingers 125 and 126 on the first support 54. The gripper arm 102 and the second support 62 have similar meshing fingers (not shown).

Operation

Referring again, in particular, to FIGS. 5–10, the finished envelopes 7 exit the roller 36 and the keeper 37 in a downward direction and enter the slots 42 in the spider 41, with the folded seal flaps 8 entering first. As the spider 41 rotates clockwise, the envelopes 7 encounter the limit stop 43, which forces them to drop out of their respective slot 42. When the envelopes 7 drop out of the respective slot 42, they fall onto the conveyor 44, folded seal flap 8 facing up. The lower rotary guide 50 and the upper rotary guide 52 insure that the envelopes 7 have an upright orientation as they are moved onto the conveyor 44. The first movable support 55 is propelled to the left at the same rate of speed that the envelopes 7 accumulate on the conveyor 44, thus providing a leftmost support for the envelope stack 54.

When a predetermined number of envelopes 7 are counted, the second and third movable supports 62 and 63 are propelled upward into the stack 54 by the cylinders 72 and 76, respectively. The supports 62 and 63 are then propelled to the left, at different speeds, by the cylinders 65 and 74, respectively, with the second support 62 compressing the envelope stack 54 to the required density just as the first support 55 reaches its leftmost position. Meanwhile, the third support 63 is advanced to the left at the same rate of speed as the envelopes 7 accumulate behind it, causing the gap 66 to open between the second and third supports 62 and 63.

Figure 9:
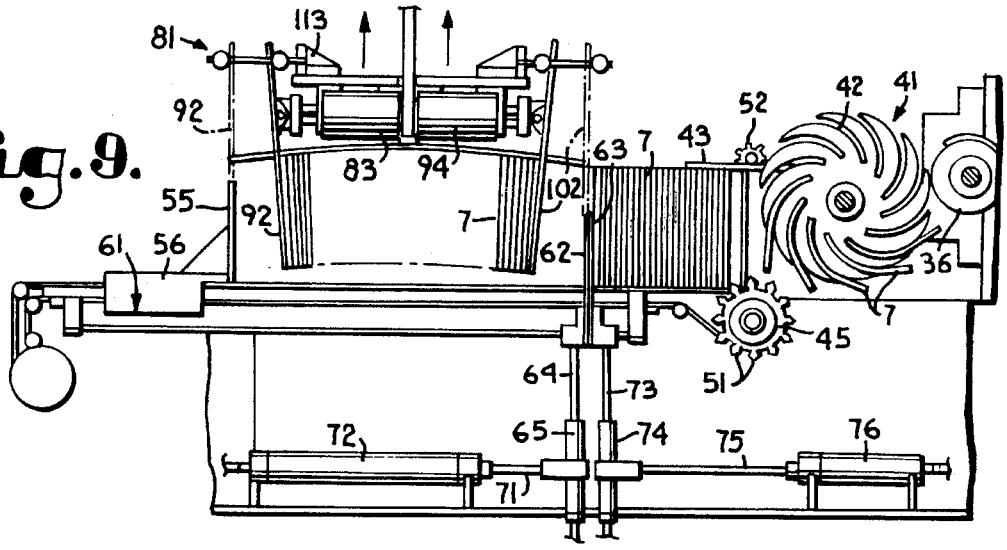
FIG. 9 is a reduced, fragmentary side elevational view of the system including the accumulation, batching and compression apparatus, showing the compressed envelope stack being grasped and picked up by the gripping and transfer apparatus, with the gripping and transfer apparatus being raised, and with additional envelopes accumulating behind the third support, which is adjacent the second support.

The gripping assembly 81 is then lowered, as shown in FIGS. 8 and 9, to a position in which the fingers 122–124 of the gripper arm 92 mesh with the corresponding fingers 125 and 126 in the first 55. The gripper arm 102 simultaneously meshes with the second support 62 in the same fashion. The double rod cylinders 83 and 94 are then actuated, with the rods 83, 84, 95 and 96 being simultaneously retracted, causing the top portions of the gripper arms 92 and 102 to abut the corresponding inner stops 112. This causes the gripper arms 92 and 102 to pivot inward at the bottom, causing the envelope stack 54 to bow upward in the center to conform to the shape of the bowed top support 115. Thus, since the envelopes 7 are loaded with the folded seal flaps 8 facing upward, the tendency for the stack 54 to spring outward at the top is accommodated by the inward pivoting bottoms of the gripper arms 92 and 102, and the bowed top support 115. The gripping assembly is then lifted by the cylinder 82 and the envelope stack 53 is transported for a further manufacturing operation, such as packaging (not shown).

Figure 10:
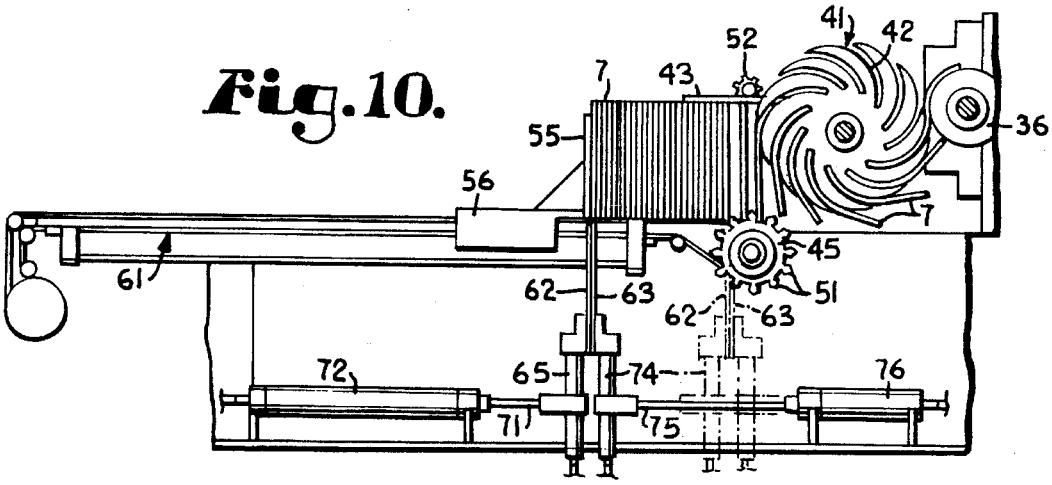
FIG. 10 is a reduced, fragmentary side elevational view of the system including the accumulation, batching and compression apparatus, showing the second and third finger supports pulled down below the conveyor in a first position in solid lines, and in a second position in phantom lines, and with envelopes again accumulating behind the first finger support.

The first support 55 is then propelled to the right to the position shown in FIG. 10, and the second support 62 is also propelled to the right to a position adjacent the third support 63. The second and third supports 62 and 63 are then simultaneously lowered to a position below the conveyor 44 by the cylinders 65 and 74, respectively, this position being shown in solid lines in FIG. 10, and then the second and third supports 62 and 63 are moved to the right to the position shown in phantom lines in FIG. 10. The envelopes 7 then begin accumulating behind the moving first support 55 and the entire cycle is repeated.

While the apparatus 41 has been shown and described in conjunction with a Standard Winkler & Dunnebier 527 Envelope Machine, it could readily be adapted to other envelope manufacturing machines.

It is to be understood that while certain forms of the present invention have been illustrated and described herein, it is not to be limited to the specific forms or arrangement of parts described and shown.

What is claimed and desired to be secured by Letters Patent is as follows:

1. In a system wherein a plurality of individual items are sequentially delivered onto a support surface at a delivery point via a delivery means, an apparatus for accumulating, batching and compressing said items into a stack containing a predetermined quantity of said items, said apparatus comprising:

(a) first support means positioned above said surface and first moving means for selectively moving said first support means generally horizontally along said surface in a first direction for initially accumulating said items as they are delivered onto said surface;

(b) sensing means for detecting said predetermined quantity of said items as they are accumulated behind said first movable support means;

(c) second support means and-second moving means for selectively moving said second support means generally vertically between a position below said surface and a position above said surface near a first location between said first support means and said delivery point in response to said sensing means detecting said predetermined quantity to thereby divide said items into first and second stacks, with said first stack including said predetermined quantity; and (c) third moving means for selectively moving said second support means generally horizontally from said first location along said surface in said first direction to a second location;

(d) said first, second and third moving means being independent from each other and separately controllable such that horizontal movement of said first support means and horizontal and vertical movement of said second support means can be independently controlled.

2. An apparatus as in claim 1, and further comprising:

(a) third support means and fourth moving means for selectively moving said third support means generally vertically between a position below said surface and a position above said surface near said first location between said second support means and said delivery point and between said first and second stacks in response to said sensing means detecting said predetermined quantity, said fourth moving means being independent from said first, second and third moving means and separately controllable such that vertical movement of said second support means can be independently controlled.

3. An apparatus as in claim 2, and further comprising:

(a) fifth moving means for selectively moving said third support means generally horizontally from said first location along said surface in the same direction as said first and said second support means to a point near said second location, said fifth moving means being independent from said first, second, third and fourth moving means and separately controllable such that horizontal movement of said second support means can be independently controlled.

4. An apparatus as in claim 3, wherein:

(a) said support surface includes a conveying means which is movable in said first direction at a rate approximately equal to a first rate at which said first moving means moves said first support means in said first direction.

5. An apparatus as in claim 4, wherein:

(a) said third moving means selectively moves said second support means between said first and second locations at a second rate faster than said first rate such that said first stack is compressed between said first and second support means; and (b) said fifth moving means selectively moves said third support means between said first and second locations at approximately the same rate as said first rate such that additional items in said second stack are accumulated behind said third support means while said first stack is compressed.

6. An apparatus as in claim 5, and further comprising:

(a) means for removing said first stack from between said first and second support means.

7. An apparatus as in claim 6, wherein:

(a) said first moving means is responsive to the removal of said first stack to selectively move said first support means above said surface in a direction opposite to said first direction to a position near said second location at a third rate faster than said first rate.

8. An apparatus as in claim 7, wherein:

(a) said second and fourth moving means selectively lower said second and third support means, respectively, from above to beneath said surface in response to said first support means reaching said position near said second location whereby said second stack then accumulates behind said first support means; and (b) said third and fifth moving means then selectively return said second and third support means, respectively, beneath said surface in a direction opposite to said first direction to a position near said first location.

9. An apparatus as in claim 8, wherein:

(a) said items are envelopes and said delivery means comprises a delivery spider.

10. An apparatus as in claim 3, wherein:

(a) said first, second, third, fourth and fifth moving means each comprise a double acting cylinder.

11. An apparatus as in claim 6, wherein:

(a) said first and second support means each include a plurality of fingers arranged to cooperate with said means for removing.

12. An apparatus as in claim 5, wherein:

(a) said sensing means comprises a counter and said quantity is a predetermined number of said items.

13. In a system wherein a plurality of envelopes are sequentially delivered onto a support surface at a delivery point via a delivery means, an apparatus for accumulating, batching and compressing said envelopes into a stack containing a predetermined quantity of said items, said apparatus comprising:

(a) first support means positioned above said surface and first moving means for selectively moving said first support means generally horizontally along said surface in a first direction for initially accumulating said envelopes as they are delivered onto said surface;

(b) sensing means for detecting said quantity of envelopes as they are accumulated behind said first movable support means; and (c) second support means and second moving means for selectively moving said second support means generally vertically between a position below said surface and a position above said surface near a first location between said first support means and said delivery point in response to said sensing means detecting said predetermined quantity to thereby divide said envelopes into first and second stacks, with said first stack containing said predetermined quantity (d) said first and second moving means being independent from each other and separately controllable such that horizontal movement of said first support means and vertical movement of said second support means can be independently controlled.

14. An apparatus as in claim 13, and further comprising:

(a) third moving means for selectively moving said second support means generally horizontally from said first location along said surface in said first direction to a second location, said third moving means being independent from said first and second moving means and separately controllable such that horizontal movement of said second support means can be independently controlled.

15. An apparatus as in claim 14, and further comprising:

(a) third support means and fourth moving means for selectively generally vertically moving said third support means between a position below said surface and a position above said surface near said first location between said second support means and said delivery point and between said first and second stacks in response to said sensing means detecting said predetermined quantity, said fourth moving means being independent from said first, second and third moving means and separately controllable such that vertical movement of said second support means can be independently controlled.

16. An apparatus as in claim 15, and further comprising:

(a) fifth moving means for selectively moving said third support means from said first location along said surface in the same direction as said first and said second support means to a point near said second location, said fifth moving means being independent from said first, second, third and fourth moving means and separately controllable such that horizontal movement of said second support means can be independently controlled.

17. An apparatus as in claim 16, wherein:

(a) said support surface includes a conveying means which is movable in said first direction at a rate approximately equal to a first rate at which said first moving means moves said first support means in said first direction.

18. An apparatus as in claim 17, wherein:

(a) said third moving means selectively moves said second support means between said first and second locations at a second rate faster than said first rate such that said first stack is compressed between said first and second support means; and (b) said fifth moving means selectively moves said third support means between said first and second locations at approximately the same rate as said first rate such that additional envelopes in said second stack are accumulated behind said third support means while said first stack is compressed.

19. An apparatus as in claim 18, and further comprising:

(a) means for removing said first stack from between said first and second support means.

20. An apparatus as in claim 19, wherein:

(a) said first moving means is responsive to the removal of said stack to selectively move said first support means above said surface in a direction opposite to said first direction to a position near said second location at a third rate faster than said first rate.

21. An apparatus as in claim 20, wherein:

(a) said second and fourth moving means selectively lower said second and third support means, respectively, from above to beneath said surface in response to said first support means reaching said position near said second location; and (b) said third and fifth moving means then selectively return said second and third support means, respectively, beneath said surface in a direction opposite to said first direction to a position near said first location.

22. An apparatus as in claim 21, wherein:

(a) said delivery means comprises a delivery spider.

23. An apparatus as in claim 16, wherein:

(a) said first, second, third, fourth and fifth moving means each comprise a double acting cylinder.

24. An apparatus as in claim 19, wherein:

(a) said first and second support means each include a plurality of fingers arranged to cooperate with said means for removing.

25. An apparatus as in claim 15, wherein:

(a) said sensing means comprises a counter and said quantity is a predetermined number of said envelopes.

26. A method of accumulating, batching and compressing predetermined quantities of envelopes from a plurality of envelopes sequentially delivered at a delivery point via a delivery means to accumulate on a support surface, the method comprising the steps of:

(a) moving a first support means along said surface generally horizontally in a first direction and at a first rate via a first moving means for initially accumulating said envelopes as they are delivered onto said surface;

(b) sensing said predetermined quantity of envelopes as they are accumulated behind said first support means;

(c) moving a second support means generally vertically between a position below said surface and a position above said surface and within said plurality of envelopes near a first location between said first support means and said delivery point via an independent second moving means in response to said sensing step to thereby separate said envelopes into first and second stacks with said first stack containing said predetermined quantity;

(d) moving said second support means from said first location generally horizontally along said surface in said first direction to a second location via an independent third moving means; and (e) moving a third support means generally vertically between a position below said surface and a position above said surface near said first location between said second support means and said delivery point and between said first and second stacks via an independent fourth moving means in response to said sensing step.

27. A method as in claim 26, and further comprising the step of:

(a) moving said third support means generally horizontally from said first location along said surface in the same direction as said first and said second support means via an independent fifth moving means to a point near said second location.

28. A method as in claim 27, wherein said support surface includes a conveying means which is movable in said first direction at a rate approximately equal to a first rate at which said first moving means moves said first support means in said first direction, said method further including the steps of:

(a) moving said second support means between said first and second locations at a second rate faster than said first rate such that said first stack is compressed between said first and second support means; and (b) moving said third support means between said first and second locations at approximately the same rate as said first rate such that additional envelopes in said second stack are accumulated behind said third support means while said first stack is compressed.

29. A method as in claim 28, and further comprising the step of:

(a) removing said first stack from between said first and second support means.

30. A method as in claim 29, and further comprising the step of:

(a) moving said first support means above said surface in a direction opposite to said first direction to a position near said second location at a third rate faster than said first rate in response to said removing step.

31. A method as in claim 30, and further comprising the step of:

(a) lowering said second and third support means, from above to below said surface in response to said first support means, reaching said position near said second location; and (b) returning said second and third support means below said surface in a direction opposite to said first direction to a position near said first location.

32. A method as in claim 26, and wherein said sensing step comprises:

(a) counting said envelopes to detect a predetermined number of said envelopes.

* * * * *